US009779754B2

(12) United States Patent
Matsuo

(10) Patent No.: US 9,779,754 B2
(45) Date of Patent: Oct. 3, 2017

(54) SPEECH ENHANCEMENT DEVICE AND SPEECH ENHANCEMENT METHOD

(71) Applicant: FUJITSU LIMITED, Kawasaki-shi, Kanagawa (JP)

(72) Inventor: Naoshi Matsuo, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/691,851

(22) Filed: Apr. 21, 2015

(65) Prior Publication Data

US 2015/0325253 A1 Nov. 12, 2015

(30) Foreign Application Priority Data

May 9, 2014 (JP) ..... 2014-098021

(51) Int. Cl.
*G10L 21/00* (2013.01)
*G10L 21/0364* (2013.01)
*G10L 21/0208* (2013.01)

(52) U.S. Cl.
CPC ..... *G10L 21/0364* (2013.01); *G10L 21/0208* (2013.01)

(58) Field of Classification Search
USPC ..... 704/225–228, 235
See application file for complete search history.

(56) References Cited

U.S. PATENT DOCUMENTS 4,811,404 A 3/1989 Vilmur et al.
2004/0151303 A1* 8/2004 Park ..... H04M 9/082 379/406.01
2010/0121634 A1* 5/2010 Muesch ..... G10L 21/0205 704/224
2010/0198593 A1* 8/2010 Yu ..... G10L 21/0208 704/233
2011/0054889 A1* 3/2011 Konchitsky ..... G10L 21/0208 704/226
2011/0125489 A1* 5/2011 Shin ..... H03G 3/32 704/205
2014/0270200 A1 9/2014 Usher et al.

FOREIGN PATENT DOCUMENTS

JP 56-84013 7/1981

OTHER PUBLICATIONS

Search Report dated Dec. 3, 2015 in corresponding United Kingdom Patent Application No. GB1507405.7, 3 pages.

* cited by examiner

*Primary Examiner* — Leonard Saint Cyr
(74) *Attorney, Agent, or Firm* — Staas & Halsey LLP

(57) ABSTRACT

A speech enhancement device which includes: a speech production section detection unit configured to detect a speech production section in which a speaker produces speech, from an input signal generated by a speech input unit; a timer unit configured to measure an elapsed time from a starting point of the speech production section; a gain determination unit configured to determine a gain, which represents a level of enhancement of the input signal, according to the elapsed time; and an enhancement unit configured to enhance the input signal or a spectrum signal of the input signal in the speech production section according to the gain, whereby the input signal is enhanced only at necessary portions thereof.

6 Claims, 18 Drawing Sheets

SPEECH ENHANCEMENT DEVICE AND SPEECH ENHANCEMENT METHOD

CROSS-REFERENCE TO RELATED APPLICATION

This application is based upon and claims the benefit of priority of the prior Japanese Patent Application No. 2014-098021, filed on May 9, 2014, the entire contents of which are incorporated herein by reference.

FIELD

The embodiments discussed herein are related to a speech enhancement device, a speech enhancement method, and a speech enhancement computer program which are configured to enhance an input signal, for example.

BACKGROUND

An input signal generated by collecting speech with a microphone may include a noise component, or a signal component corresponding to voice of a speaker may be small in the input signal. When an input signal includes a noise component or when the signal component is small, speech of a speaker may be unclear in the input signal. In addition, in the case of a device configured to recognize speech of a speaker in an input signal and perform processing corresponding to the speech, if the speech of the speaker is unclear, the device may fail to perform desired processing due to deterioration of the accuracy of speech recognition. To address this, a technology called Auto Gain Control (AGC) that automatically adjusts the level of an input signal has been utilized (see Japanese Laid-open Patent Publication No. 56-84013, for example).

However, excessive adjustment of the level of an input signal may increase distortion of the input signal or may even enhance a noise component, and speech of a speaker may not typically become clear. In particular, when one word is long, the voice of a speaker tends to become smaller as the speech comes close to the ending of the word. As a result, a signal corresponding to the word may not be clearly identified in the input signal. In such a case, even if the conventional AGC is applied to the input signal, the speech of the speaker included in that input signal may remain unclear.

Hence, as one aspect, an object of the specification is to provide a speech enhancement device capable of making clear speech of a speaker which is included in an input signal, even when volume of speech produced by the speaker changes according to a time from beginning of speech production.

SUMMARY

According to an aspect of the invention, a speech enhancement device includes: a speech production section detection unit configured to detect a speech production section in which a speaker produces speech, from an input signal generated by a speech input unit; a timer unit configured to measure an elapsed time from a starting point of the speech production section; a gain determination unit configured to determine a gain, which represents a level of enhancement of the input signal, according to the elapsed time; and an enhancement unit configured to enhance the input signal or a spectrum signal of the input signal in the speech production section according to the gain, whereby the input signal is enhanced only at necessary portions thereof.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A speech enhancement device according to an embodiment is described hereinafter with reference to the drawings.

When a speaker continuously produces speech for a long period of time, volume of speech produced by the speaker may be reduced towards the ending of a word. Thus, even when the level of an input signal is adjusted using a same gain over an entire speech production section that is a section in an input signal in which the speaker produces speech, the speech of the speaker does not necessarily become clear.

In addition, even when an input signal is separated into sub-sections each being shorter than a speech production section and the levels of the input signals in the sub-sections are individually and independently adjusted, a gain may discontinuously change in adjacent sections. Thus, speech may be distorted, or noise may be enhanced in a part, in which the volume of speech produced by the speaker is temporarily reduced, between two consecutive speech production sections or within a single speech production section. Consequently, the speech of the speaker may not become clear.

Hence, this speech enhancement device adjusts a gain of an input signal, which represents a level of enhancement of the input signal according to an elapsed time from a starting point of a speech production section of a speaker, and thereby makes clear speech of the speaker in the input signal even when the volume of the speech produced by the speaker changes according to the elapsed time. Then, by enhancing the input signal from a time point when the elapsed time reaches a predetermined time, this speech enhancement device may make clear the speech of the speaker in the input signal even when the volume of produced speech at the ending of the word is reduced.

Figure 1:
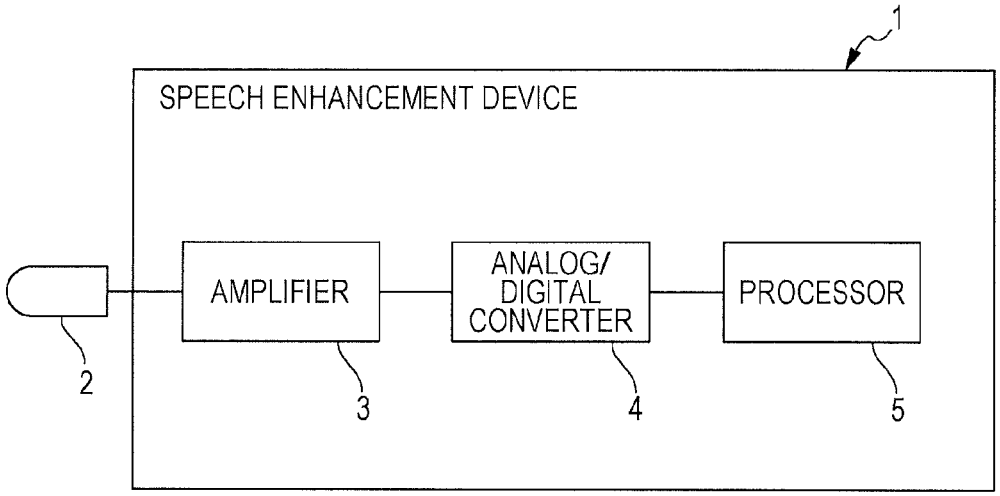
FIG. 1 is a schematic configuration diagram of a speech enhancement device according to a first embodiment.

FIG. 1 is a schematic configuration diagram of a speech enhancement device according to a first embodiment. A speech enhancement device 1 has a microphone 2, an amplifier 3, an analog/digital converter 4, and a processor 5. The speech enhancement device 1 is mounted in a vehicle, for example, to enhance speech of a speaker (driver, for example) who is in a car compartment.

The microphone 2 is an example of a speech input unit and configured to collect sound around the speech enhancement device 1, generate an analog input signal corresponding to intensity of the sound, and output the analog input signal to the amplifier 3. The amplifier 3 is configured to amplify an analog input signal and then output the amplified analog input signal to the analog/digital converter 4. The analog/digital converter 4 is configured to generate a digitalized input signal by sampling the amplified analog input signal in a predetermined sampling cycle. Then, the analog/digital converter 4 is configured to output the digitalized input signal to the processor 5. Note that the digitalized input signal is hereinafter simply referred to as an input signal.

The processor 5 has one or more processor components, a readable and writable memory circuit, and a peripheral circuit of the memory circuit. Then, the processor 5 obtains a corrected input signal by performing speech enhancement processing on an input signal. Then, the processor 5 performs speech recognition processing on the corrected input signal and performs processing according to speech of a speaker. Alternatively, the processor 5 may output the corrected input signal to other devices via a communication interface (not illustrated).

Figure 2:
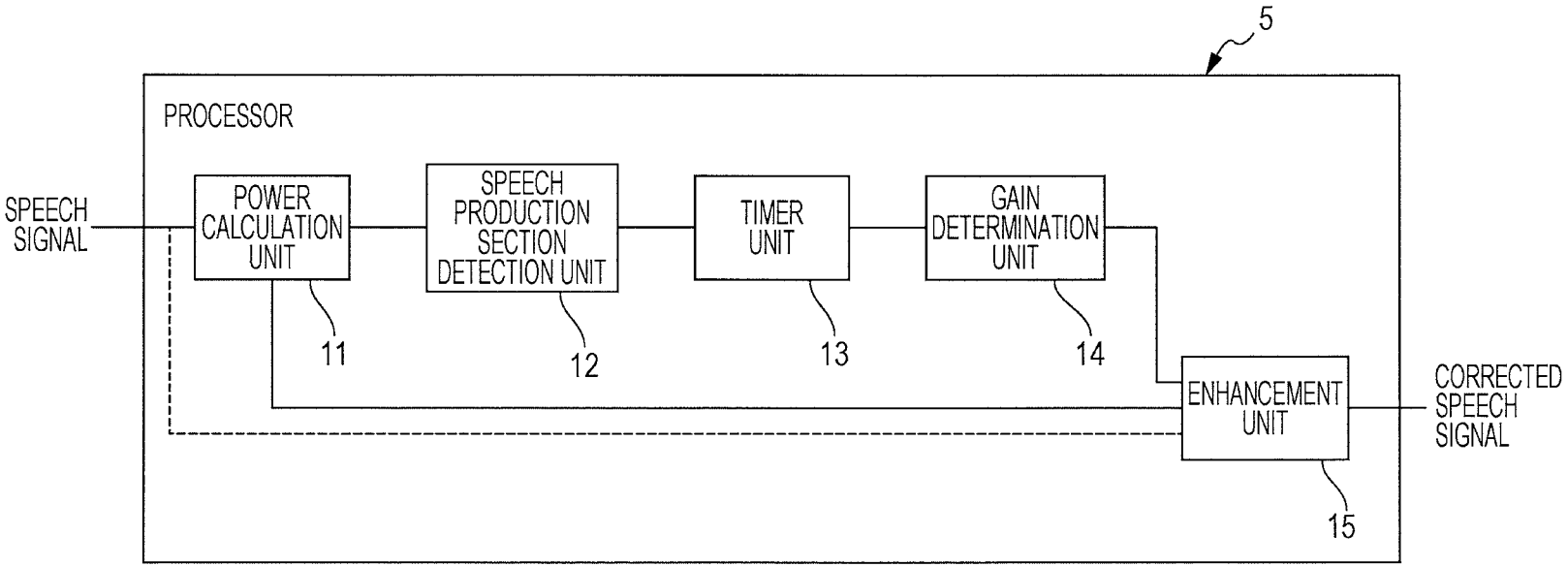
FIG. 2 is a schematic configuration diagram of a processor of the speech enhancement device according to the first embodiment.

FIG. 2 is a schematic configuration diagram of the processor 5. The processor 5 includes a power calculation unit 11, a speech production section detection unit 12, a timer unit 13, a gain determination unit 14, and an enhancement unit 15. Each unit included in the processor 5 is a functional module implemented by a computer program which is running on a digital signal processor. Alternatively, each of these units may be one or more firmware that implements a function of each of these units.

The power calculation unit 11 is configured to divide an input signal for every frame having predetermined length and calculate power of speech in every frame. Frame length is set to 32 msec, for example. Note that the power calculation unit 11 may also make a part of two continuous frames overlap. In this case, the power calculation unit 11 may also set to 10 msec to 16 msec, for example, a frame shift amount to be included in a new frame when a shift is made from a current frame to a next frame.

The power calculation unit 11 uses time-frequency transform to transform an input signal from a time domain into a spectrum signal in a frequency domain, for every frame. The power calculation unit 11 may use, for example, fast Fourier transform (FFT) or modified discrete cosine transform (MDCT) as the time-frequency transform. Note that the power calculation unit 11 may also perform the time-frequency transform after multiplying each frame by a window function like Hamming window or Hanning window.

For example, when frame length is 32 msec and a sampling rate of the analog/digital converter 4 is 8 kHz, every frame includes 256 sample points. Thus, the power calculation unit 11 performs FFT on the 256 points.

For every frame, the power calculation unit 11 calculates from a spectrum signal of that frame a power integration value in a frequency band in which human voice is included, as a characteristic amount representative of characteristics of the human voice.

The power calculation unit 11 calculates a power integration value in a frequency band in which human voice is included, according to the following expression, for example:

$$P = 10\log_{10}\left\{\sum_{f=fmin}^{fmax} |S(f)|^2\right\}(\text{dB}) \tag{1}$$

where S(f) is a spectrum signal at a frequency f, and $|S(f)|^2$ is a power spectrum at the frequency f. In addition, fmin and fmax each represents a lower limit and an upper limit of a frequency band in which human voice is included. Then, P is a power integration value.

Note that the power calculation unit 11 may directly determine a power integration value from a square sum of a sample point in every frame, without performing the time-frequency transform of the frame.

The power calculation unit 11 notifies the speech production section detection unit 12 of the power integration value in every frame. The power calculation unit 11 also outputs a spectrum signal of each frequency for every frame to the speech production section detection unit 12 and the enhancement unit 15. Note that instead of enhancing a spectrum signal, the power calculation unit 11 may directly enhance an inputted input signal, as depicted by a dot-line in FIG. 2. In the following description and statements in the claims, a "input signal" may include both an inputted input signal and a spectrum signal obtained by transforming the inputted input signal.

The speech production section detection unit 12 detects a speech production section from the input signal based on the power integration values for the respective frames. In the first embodiment, the speech production section detection unit 12 detects a speech production section by judging whether or not each frame is included in the speech production section based on the power integration value for the frame.

When a power integration value of a frame on which the speech production section detection unit 12 focuses is larger than a noise judgment threshold Thn, the speech production section detection unit 12 judges that the frame is included in a speech production section. In addition, it is preferable that the noise judgment threshold Thn is adaptively set according to a background noise level included in an input signal. Then, when an integration value of a power spectrum of an entire frequency band of a frame is less than a predetermined power threshold, the speech production section detection unit 12 judges that the frame is a silent frame in which any sound other than the background noise is not included. Then, the speech production section detection unit 12 estimates the background noise level based on the power integration value of the silent frame. For example, the speech production section detection unit 12 estimates the background noise level according to the following expression:

$$\text{noise}P' = 0.01 \cdot Ps + 0.99 \cdot \text{noise}P \quad (2)$$

where Ps is a power integration value in the newest silent frame, and noiseP is the background noise level prior to updating. Then, noiseP' is the background noise level after updating. In this case, the noise judgment threshold Thn is set according to the following expression, for example:

$$Thn = \text{noise}P + \gamma \quad (3)$$

where $\gamma$ is a preset constant and set to 2 to 3 [dB], for example.

For every frame, the speech production section detection unit 12 notifies the timer unit 13 of a judgment result of whether or not the frame is included in a speech production section.

The timer unit 13 has a timer, for example, and is configured to measure an elapsed time after a speech production section starts. In the first embodiment, the timer unit 13 starts time measurement when a last frame is not included in a speech production section and a current frame is included in the speech production section. Then, the timer unit 13 continues the time measurement of the elapsed time while receiving from the speech production section detection unit 12 a judgment result that a frame is included in the speech production section. Then, when receiving from the speech production section detection unit 12 a judgment result that a frame is not included in the speech production section, the timer unit 13 finishes the time measurement and resets the elapsed time to 0. In addition, the timer unit 13 sets the elapsed time to 0 for a frame which is not included in a speech production section.

For every frame, the timer unit 13 notifies the gain determination unit 14 of the elapsed time after a speech production section starts.

The gain determination unit 14 adjusts a gain which represents a level of enhancement of an input signal according to the elapsed time after a speech production section starts. In the first embodiment, the gain determination unit 14 keeps the gain at a certain level till the elapsed time after the start of the speech production section exceeds adjustment start time. When the elapsed time exceeds the adjustment start time, the gain determination unit 14 sets the gain higher as the elapsed time is longer. With this, even if volume of produced speech of a speaker becomes smaller towards the ending of a word, the speech enhancement device 1 may selectively enhance the speech of an ending part of the word. On the other hand, the speech enhancement device 1 may control excessive enhancement of a leading part of a speech production section whose volume is sufficient, and thereby suppress distortion of a corrected input signal.

Figure 3:
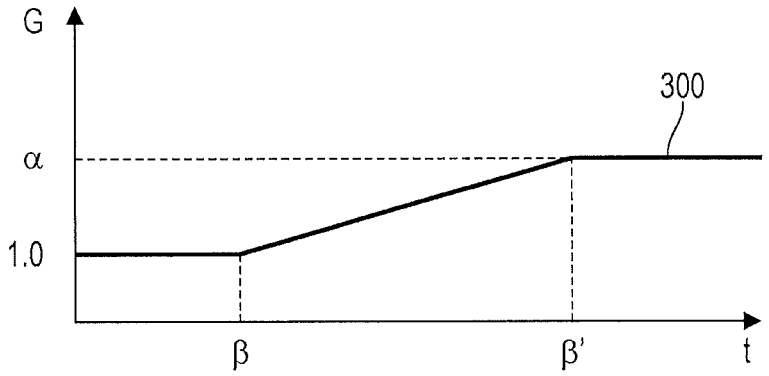
FIG. 3 is a view illustrating an example of a relation of an elapsed time from a starting point of a speech production section and a gain.

FIG. 3 is a view illustrating an example of a relation of an elapsed time from a starting point of a speech production section and a gain. In FIG. 3, a horizontal axis represents an elapsed time and a vertical axis a gain. Then, a graph 300 illustrates a relation of the elapsed time and the gain. As illustrated in the graph 300, a gain G is kept at 1.0 till the elapsed time from a starting point of a speech production section exceeds the adjustment start time $\beta$. More specifically, an input signal remains unadjusted from the starting point of the speech production section till the adjustment start time $\beta$ elapses. Then, after the elapsed time exceeds the adjustment start time $\beta$, the gain G linearly and monotonously increases as the elapsed time is longer. When the elapsed time reaches adjustment completion time $\beta'$, the gain G becomes an upper limit a and remains at that level. Then, after the elapsed time exceeds the adjustment completion time $\beta'$, the gain G is kept at the level of $\alpha$, so that the level of an input signal is discontinuous and distortion of the input signal may not be too large. Then, when the speech production section ends, the gain G is reset to 1.0. Here, the adjustment start time $\beta$ is set to have a length of one or two vowels, 100 msec, for example. In addition, the adjustment completion time $\beta'$ may be a time period obtained by adding 6000 msec to $\beta$. Then, the upper limit $\alpha$ of the gain G is set to a gain value, 1.2, for example, at which discontinuity of a corrected input signal that is generated due to a gain change in a frame falls within an allowable range.

Figure 4:
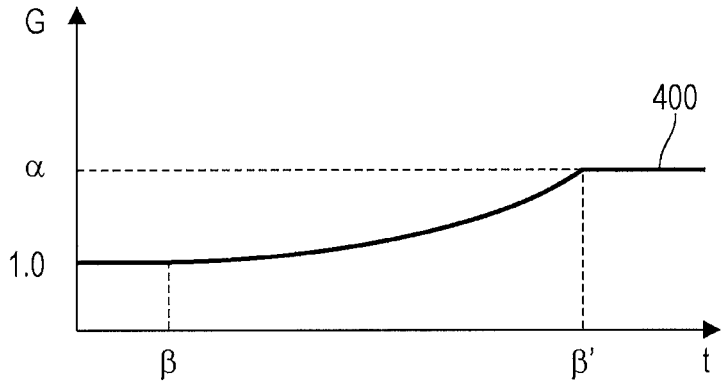
FIG. 4 is a view illustrating other example of a relation of an elapsed time from a starting point of a speech production section and a gain.

FIG. 4 is a view illustrating other example of an elapsed time from a starting point of a speech production section and a gain. Also in FIG. 4, a horizontal axis represents an elapsed time and a vertical axis a gain. Then, a graph 400 represents a relation of the elapsed time and the gain. Unlike the graph 300 illustrated in FIG. 3, in this example, as illustrated in the graph 400, an increased amount of the gain G per unit time is larger as the elapsed time from the starting point of the speech production section is longer. Also in this example, however, the gain G is kept at 1.0 till the elapsed time exceeds the adjustment start time $\beta$, and when the elapsed time exceeds the adjustment completion time $\beta'$, the gain G becomes $\alpha$ and remains at that level. In this example, the gain G is calculated with the following expression, for example, from when the elapsed time exceeds the adjustment start time $\beta$ till the elapsed time reaches the adjustment completion time $\beta'$.

$$G = \rho^{(t-\beta)} (\text{When } \beta \leq t < \beta') \quad (4)$$

where t represents an elapsed time from a starting point of a speech production section. In addition, $\rho$ is a constant larger than 1.0.

Depending on a speaker, volume is rapidly reduced when the speaker comes closer to the ending of a word. Even in such a case, according to the above example, since the speech enhancement device 1 rapidly increases the gain G as the speaker comes closer to a termination of a speech production section, the speech enhancement device 1 may appropriately enhance a part in which the volume is reduced in speech of the speaker.

In addition, the adjustment start time β may be set to 0. More specifically, the gain G may be adjusted from the starting point of the speech production section. In this case, it is preferable that the gain G is calculated according to the expression (4), so that an input signal is not excessively enhanced in a leading part of a speech production section in which volume of produced speech of a speaker is sufficient.

The gain determination unit 14 determines the gain G by the graph in FIG. 3 or FIG. 4 mentioned above, according to the elapsed time from the starting point of the speech production section. Then, the gain determination unit 14 notifies the enhancement unit 15 of the gain G for every frame.

The enhancement unit 15 enhances an input signal for every frame, according to the gain G received from the gain determination unit 14. In the first embodiment, the enhancement unit 15 enhances a spectrum signal of each frequency, according to the following expression:

$$\begin{aligned} 10\log_{10}(S'(f)^2) &= 10\log_{10}(S(f)^2) + 10\log_{10}G \\ &= 10\log_{10}(G\cdot S(f)^2) \end{aligned} \tag{5}$$

where $S'(f)^2$ represents a power spectrum of a frequency f after enhancement. Then, S'(f) represents a spectrum signal of the frequency f after enhancement. Note that the enhancement unit 15 may reduce a noise component from the enhanced power spectrum $S'(f)^2$.

The enhancement unit 15 obtains a corrected input signal for every frame by transforming a corrected spectrum signal into a signal in a time domain through frequency-time transform. Note that the frequency-time transform is inverse transform of the time-frequency transform performed by the power calculation unit 11. Lastly, the enhancement unit 15 obtains a corrected input signal by combining a corrected input signal of every continuous frame.

Figure 5A:
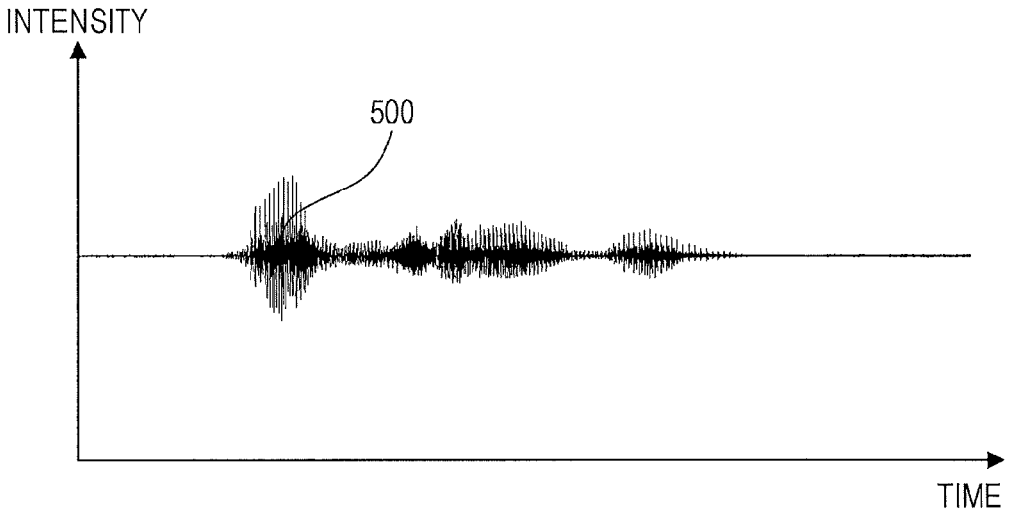
FIG. 5A is a view illustrating an example of signal waveform of an original input signal.
Figure 5B:
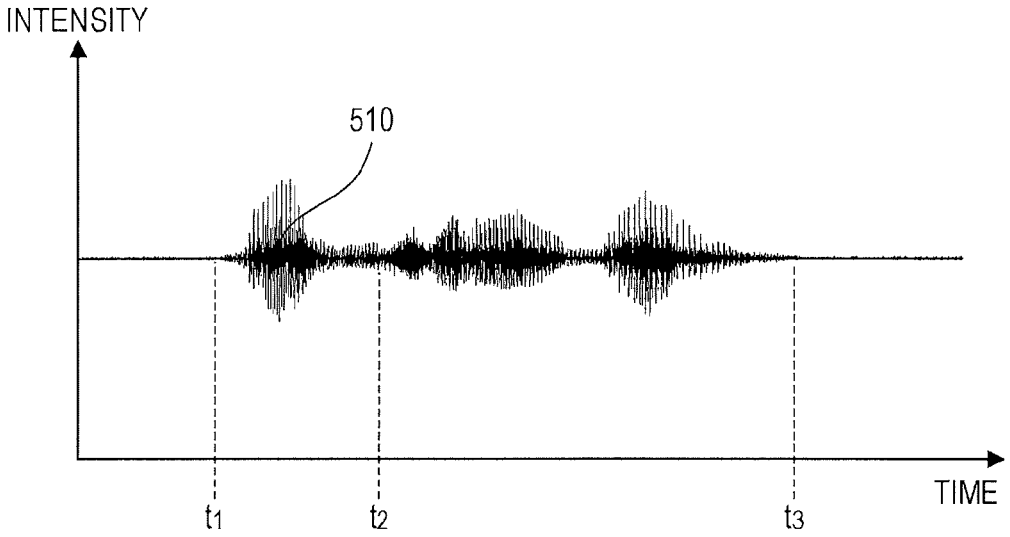
FIG. 5B is a view illustrating an example of signal waveform of a corrected input signal obtained by a speech enhancement device according to the first embodiment.

FIG. 5A is a view illustrating an example of signal waveform of an original input signal. FIG. 5B is a view illustrating an example of signal waveform of a corrected input signal obtained by the speech enhancement device according to the first embodiment. In FIG. 5A and FIG. 5B, a horizontal axis represents time and a vertical axis represents intensity of amplitude of an input signal. Signal waveform 500 is signal waveform of an original input signal. In addition, signal waveform 510 is signal waveform of a corrected input signal with the speech enhancement device 1 according to the first embodiment. In this example, after time point $t_1$ when a speech production section starts, the input signal is enhanced between time point $t_2$ when volume begins to drop and time point $t_3$ when the speech production section ends.

Figure 6:
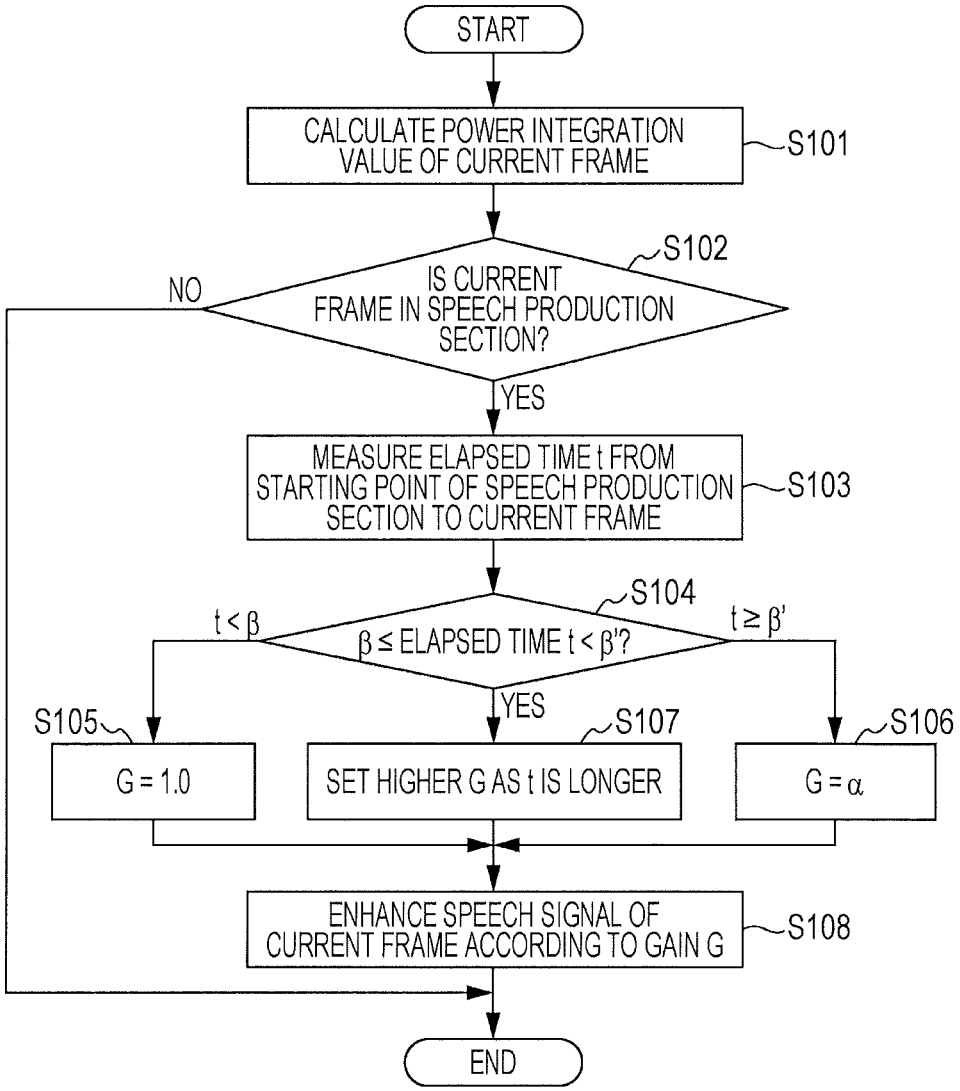
FIG. 6 is an operation flow chart of speech enhancement processing according to the first embodiment.

FIG. 6 is an operation flow chart of speech enhancement processing according to the first embodiment. The speech enhancement device 1 performs the speech enhancement processing on every frame according to the following operation flow chart.

The power calculation unit 11 divides an input signal for every frame and calculates a power integration value in a current frame (step S101). Then, the power calculation unit 11 outputs the power integration value to the speech production section detection unit 12 and a spectrum signal of each frequency to the speech production section detection unit 12 and the enhancement unit 15.

The speech production section detection unit 12 judges based on the power integration value whether or not the current frame is included in the speech production section (step S102). When the current frame is not included in the speech production section (step S102—No), the processor 5 does not enhance the input signal. Then, the processor 5 finishes the speech enhancement processing. On the other hand, when the current frame is included in the speech production section (step S102—Yes), the speech production section detection unit 12 notifies the timer unit 13 of the judgment result.

The timer unit 13 measures an elapsed time t from a starting point of the speech production section to the current frame, according to the judgment result received from the speech production section detection unit 12 (step S103). Then, the timer unit 13 notifies the gain determination unit 14 of the elapsed time t.

The gain determination unit 14 judges whether or not the elapsed time t from beginning of the speech production section is between the adjustment start time β, inclusive, and the adjustment completion time β', exclusive (step S104). When the elapsed time t does not reach the adjustment start time β (step S104—No), the gain determination unit 14 sets the gain G to 1.0 (step S105). In addition, when the elapsed time t reaches or exceeds the adjustment completion time β' (step S104—No), the gain determination unit 14 sets the gain G to α (step S106). On the other hand, when the elapsed time t is between the adjustment start time β, inclusive, and the adjustment completion time β', exclusive (step S104—Yes), the gain determination unit 14 sets the gain G to a value which is higher as the elapsed time t is longer (step S107). After step S105, S106, or S107, the gain determination unit 14 notifies the enhancement unit 15 of the gain G.

The enhancement unit 15 enhances the input signal of the current frame according to the gain G to obtain a corrected input signal (step S108).

Then, the speech enhancement device 1 finishes the speech enhancement processing.

As described above, since the speech enhancement device adjusts a gain according to an elapsed time from a starting point of a speech production section, the speech enhancement device may appropriately correct an input signal according to a change in volume of produced speech of a speaker in the speech production section. For example, even when speech of a long word is produced while causing the volume of produced speech to drop towards the ending of the word, the speech enhancement device may correct the input signal so that the speech of the speaker becomes clear. Since the speech enhancement device determines a gain depending on an elapsed time from beginning of a speech production section, the gain continuously changes unlike a case in which gain is determined for every short period of time. Such continuous change in the gain makes it less likely to generate a discontinuous part in a corrected input signal. Thus, the speech enhancement device may obtain a corrected input signal which may contribute to an improvement in the accuracy of the speech recognition.

Then, a speech enhancement device according to a second embodiment is described hereinafter. The speech enhancement device according to the second embodiment determines likelihood of human voice in a speech production section and increases a gain as the human voice likelihood is higher.

Figure 7:
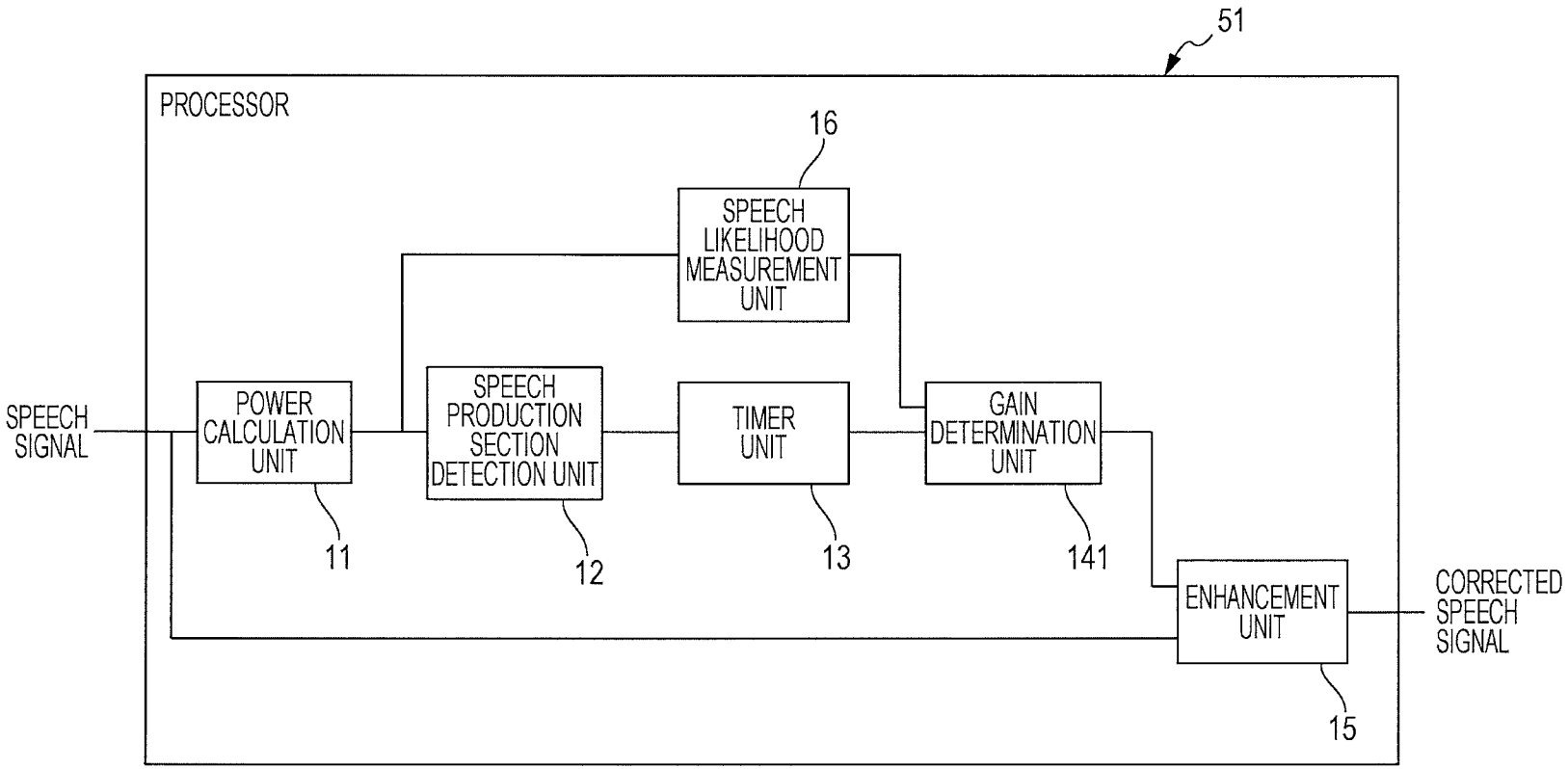
FIG. 7 is a schematic configuration diagram of a processor of a speech enhancement device according to a second embodiment.

FIG. 7 is a schematic configuration diagram of a processor of the speech enhancement device according to the second embodiment. A processor 51 has a power calculation unit 11, a speech production section detection unit 12, a timer unit 13, a gain determination unit 141, an enhancement unit 15, and a speech likelihood measurement unit 16.

In FIG. 7, to components of the processor 51 are assigned same reference numerals as the reference numerals for corresponding components of the processor 5 illustrated in FIG. 2.

The processor 51 of the speech enhancement device according to the second embodiment is different from the processor 5 of the speech enhancement device according to the first embodiment in that the processor 51 has the speech likelihood measurement unit 16 and performs different processing of the gain determination unit 14. Thus, the speech likelihood measurement unit 16 and the gain determination unit 14 are described hereinafter. For other components of the speech enhancement device, see the description on the corresponding components of the first embodiment.

The speech likelihood measurement unit 16 determines speech likelihood, which is a degree representative of human voice likelihood, for every frame of an input signal included in a speech production section. In the second embodiment, a microphone 2 is installed to collect sound of speaker's voice. Thus, when power of an input signal is large, it is considered that the speaker is producing speech. Then, the speech likelihood measurement unit 16 determines speech likelihood $\tau$ based on a power integration value P of an input signal in a speech production section. In addition, in the second embodiment, the speech likelihood $\tau$ takes a value from 0 to 1 and indicates that an input signal more likely represents human voice as the value is larger.

Figure 8:
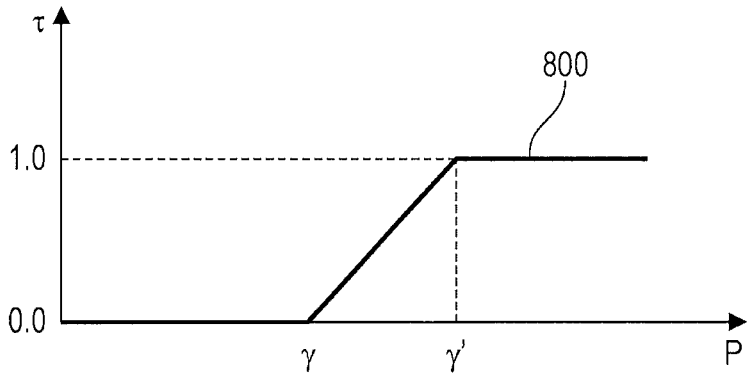
FIG. 8 is a view illustrating an example of a relation of a power integration value and speech likelihood.

FIG. 8 is a view illustrating an example of a relation of a power integration value and speech likelihood. In FIG. 8, a horizontal axis represents a power integration value P and a vertical axis speech likelihood $\tau$. Then, a graph 800 represents a relation of the power integration value P and the speech likelihood $\tau$. As illustrated in the graph 800, when the power integration value P is equal to or less than a lower limit threshold $\gamma$, the speech likelihood measurement unit 16 sets the speech likelihood $\tau$ to 0.0.

On the other hand, when the power integration value P exceeds the lower limit threshold $\gamma$ and is equal to or less than an upper limit threshold $\gamma'$, the speech likelihood measurement unit 16 linearly and monotonously increases the speech likelihood $\tau$ as the power integration value P is larger. Then, when the power integration value P exceeds the upper limit threshold $\gamma'$, the speech likelihood measurement unit 16 sets the speech likelihood $\tau$ to 1.0. More specifically, the speech likelihood measurement unit 16 calculates the speech likelihood $\tau$ according to the following expression:

$$\tau=0.0 P<\gamma$$

$$\tau=(P-\gamma)/(\gamma'-\gamma)\gamma\leq P<\gamma'$$

$$\tau=1.0\gamma\leq P' \quad (6)$$

In addition, the lower limit threshold $\gamma$ is set to an average value of power integration values P of respective frames included in an immediate predetermined period, for example. The predetermined period is set to several seconds to several tens of seconds so that more than one speech production section is included, for example. Alternatively, the lower limit threshold $\gamma$ may be a background noise estimated value noiseP' calculated with the expression (2) or a value obtained by adding a predetermined offset value (1 to 3 dB, for example) to the background noise estimated value noiseP'. Alternatively, the lower limit threshold $\gamma$ may also be a fixed value that is set in advance. In addition, the upper limit threshold $\gamma'$ is set to a value obtained by adding a predetermined value to the lower limit threshold $\gamma$. Note that a predetermined value is experimentally defined and set to +12 dB, for example, so that the predetermined value is a power integration value from which it is estimated that an input signal is certainly human voice.

The speech likelihood measurement unit 16 outputs the determined speech likelihood $\tau$ to the gain determination unit 14.

The gain determination unit 14 determines a gain G according to an elapsed time from a starting point of a speech production section, similar to the gain determination unit 14 according to the first embodiment. Then, the gain determination unit 14 corrects the gain G according to the elapsed time from the starting point of the speech production section, so that the gain G is higher as the speech likelihood $\tau$ is higher. In the second embodiment, the gain determination unit 14 corrects the gain G according to the following expression:

$$G'=1.0+\tau(G-1.0) \quad (7)$$

In the expression (7), G' is a corrected gain. As apparent from the expression (7), when the gain G prior to correction is 1.0 or the speech likelihood is 0.0, the corrected gain G' is also 1.0. More specifically, even when the corrected gain G' is used, the input signal remains unadjusted. On the other hand, when the gain G prior to correction is larger than 1.0 and the speech likelihood $\tau$ is also larger than 0.0, the corrected gain G' is also higher as the gain G is higher and the speech likelihood $\tau$ is higher. Therefore, an input signal in the speech production section is more enhanced, as the input signal comes closer to the trailing end of a speech production section and as the input signal more likely represents human voice.

The gain determination unit 14 outputs the corrected gain G' for every frame to the enhancement unit 15. The enhancement unit 15 enhances the input signal in the speech production section, using the corrected gain G' instead of the gain G in the second embodiment described above. More specifically, the enhancement unit 15 calculates a corrected frequency spectrum using the corrected gain G' instead of the gain G in the expression (5).

Figure 9:
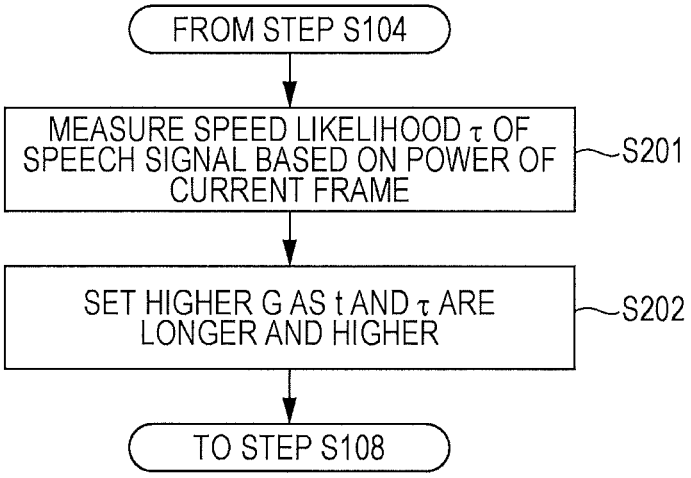
FIG. 9 is an operation flow chart of speech enhancement processing according to the second embodiment.

FIG. 9 is an operation flow chart of speech enhancement processing according to the second embodiment. The operation flow chart of the speech enhancement processing according to the second embodiment is different, in processing of step S107, from the operation flow chart of the speech enhancement processing according to the first embodiment. Thus, in FIG. 9, processing to be performed instead of the processing of step S107 is described.

When it is judged in step S104 that the elapsed time t is between the adjustment start time $\beta$, inclusive, and the adjustment completion time $\beta'$, exclusive, the speech likelihood measurement unit 16 determines the speech likelihood $\tau$ of the input signal in the current frame, based on power of the current frame (step S201). Then, the speech likelihood measurement unit 16 notifies the gain determination unit 14 of the speech likelihood $\tau$.

The gain determination unit 14 sets the gain G so that the gain G is higher, as the elapsed time t is longer and as the speech likelihood $\tau$ is higher (step S202). Then, the gain determination unit 14 outputs the gain G to the enhancement unit 15. Subsequently, the processor 51 performs the processing after step S108.

According to the second embodiment, the speech enhancement device enhances an input signal more as the input signal included in a speech production section more likely represents human voice. Thus, the speech enhancement device may enhance human voice included in the input signal more than other speech. Accordingly, since human voice included in the input signal becomes clear, the speech enhancement device may further improve the recognition accuracy of the speech recognition processing which utilizes a corrected input signal.

In addition, the speech enhancement device may have a plurality of microphones. In this case, the speech enhancement device may detect a sound source direction, which is an incoming sound direction, from a phase difference in spectra of input signals collected by each of the microphones. Then, a speech enhancement device according to a third embodiment utilizes a plurality of microphones to detect a sound source direction and determines speech likelihood of an input signal in a speech production section according to the sound source direction. Then, depending on the speech likelihood of an input signal estimated from the sound source direction, the speech enhancement device corrects a gain which is set according to an elapsed time from the starting point of the speech production section.

Figure 10:
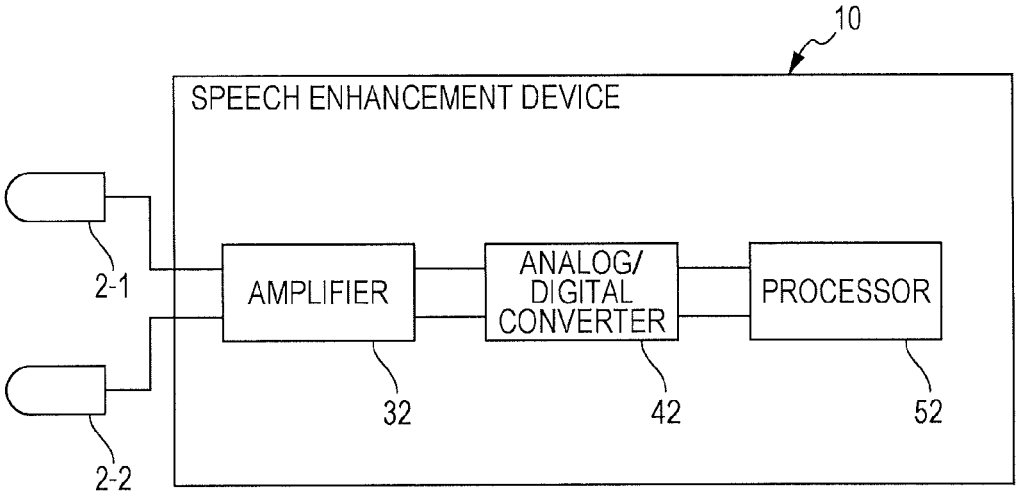
FIG. 10 is a schematic configuration diagram of a speech enhancement device according to a third embodiment.

FIG. 10 is a schematic configuration diagram of the speech enhancement device according to the third embodiment. A speech enhancement device 10 has two microphones 2-1 and 2-2, a two-channel amplifier 32, a two-channel analog/digital converter 42, and a processor 52.

The speech enhancement device 10 according to the third embodiment is different from the speech enhancement device according to the second embodiment in that the speech enhancement device 10 has two microphones and that a part of processing performed by the processor 52 is different. Thus, the microphones 2-1 and 2-2, and the processor 52 are described hereinafter.

The microphones 2-1 and 2-2 are spaced at a certain distance so that a sound source direction may be detected. For example, when the speech enhancement device 10 desires to selectively enhance an input signal including voice of a driver in a car compartment, the microphone 2-1 and the microphone 2-2 are arranged, for example, in front of a driver seat side by side in a direction almost parallel to a line connecting the driver seat and a front passenger seat and are arranged to face the driver seat. Then, the microphone 2-1 and the microphone 2-2 are arranged so that a distance d of the microphone 2-1 and the microphone 2-2 is a value (V/Fs) obtained by dividing sound speed V by a sampling frequency Fs of the analog/digital converter 4. When the distance of the microphones is wider than this condition, phase rotation occurs in a phase spectrum on a high frequency side, and the detection accuracy of a sound source direction degrades.

In addition, it is assumed that the microphone 2-1 is arranged to the left of the microphone 2-2, and thus hereinafter, an input signal collected by the microphone 2-1 is referred to as a left input signal and an input signal collected by the microphone 2-2 a right input signal.

Sound collected by the microphone 2-1 and sound collected by the microphone 2-2 are each amplified by the amplifier 3, then digitalized by the analog/digital converter 4, and inputted to the processor 52.

Figure 11:
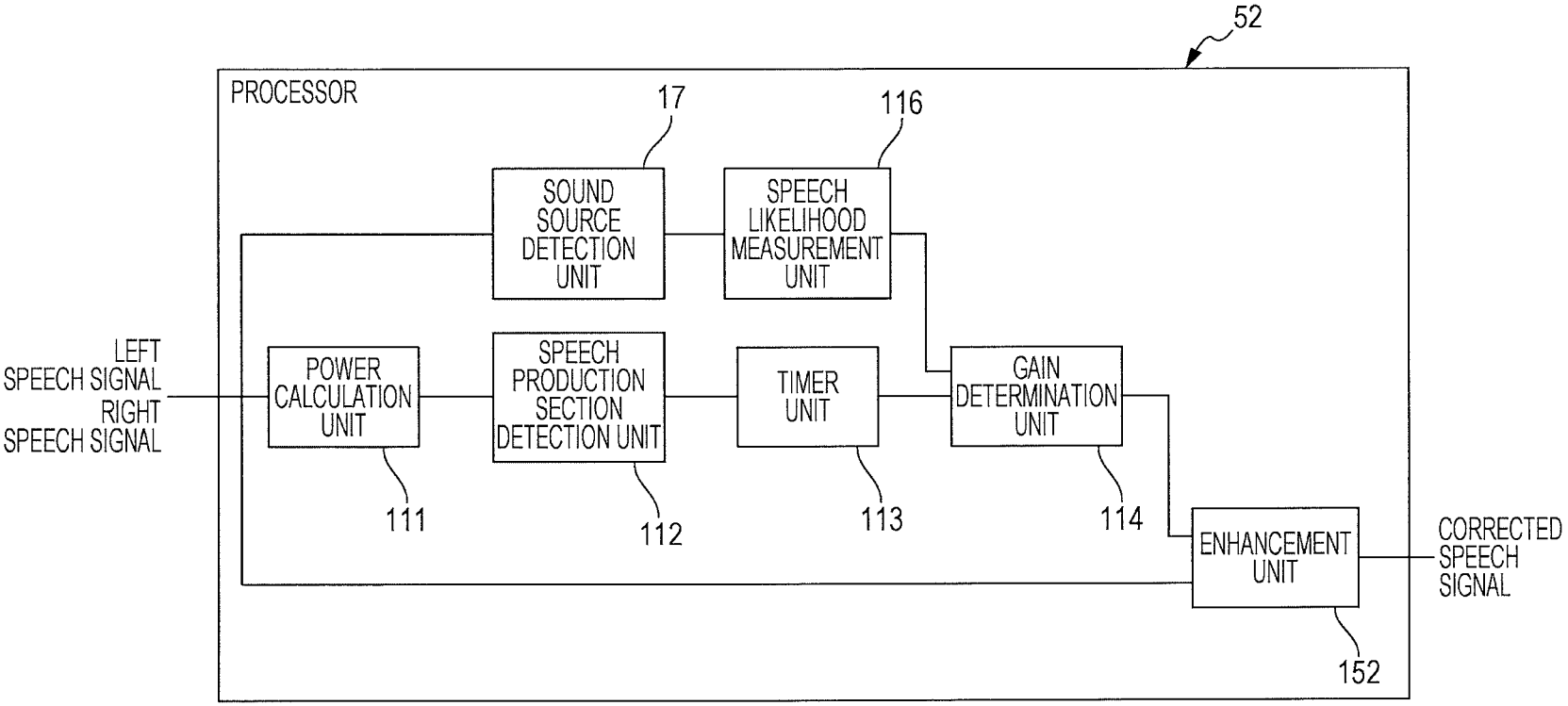
FIG. 11 is a schematic configuration diagram of a processor of the speech enhancement device according to the third embodiment.

FIG. 11 is a schematic configuration diagram of a processor of the speech enhancement device according to the third embodiment. The processor 52 has a two-channel power calculation unit 111, a two-channel speech production section detection unit 112, a two-channel timer unit 113, a two-channel gain determination unit 114, a two-channel enhancement unit 152, a two-channel speech likelihood measurement unit 116, and a sound source direction detection unit 17. The processor 52 is different from the processor 51 according to the second embodiment in that the processor 52 has the sound source direction detection unit 17 and that a method for determining speech likelihood by the speech likelihood measurement unit 116 is different. Thus, the following description is provided for the sound source direction detection unit 17, the speech likelihood measurement unit 116, and parts related thereto.

In the third embodiment, the speech production section detection unit 112 may also detect a speech production section based on any of a left input signal and a right input signal. For example, the speech production section detection unit 112 may detect a speech production section based on a left input signal or a right input signal which has a larger power integration value. Similar to the enhancement unit 15 according to the second embodiment, the enhancement unit 152 enhances any one of a left input signal and a right input signal or both by using a corrected gain G' calculated by the gain determination unit 114.

The sound source direction detection unit 17 detects a direction of a sound source based on a left input signal and a right input signal, for every frame. For example, when a difference between an arrival time of a left input signal and an arrival time of a right input signal is δ, the sound source direction detection unit 17 calculates a sound source direction θ with the following expression. Note that a direction orthogonal to the arrangement direction of the microphone 2-1 and the microphone 2-2 is 0 degree.

$$\theta=\sin^{-1}(v\delta/d)=\sin^{-1}(Fs\delta) \tag{8}$$

where v represents a sound velocity, d represents a distance between the two microphones, Fs represents a sampling frequency.

In addition, the sound source direction detection unit 17 calculates, for example, a cross-correlation value of the left input signal and the right input signal and may make a time difference when the cross-correlation value is maximum a difference δ between the arrival time of a left input signal and the arrival time of a right input signal. Alternatively, the sound source direction detection unit 17 may calculate a difference δ in the arrival time δ from a difference between a phase of a spectrum signal of the left input signal and a phase of a spectrum of the right input signal. The sound source direction detection unit 17 outputs the sound source direction θ determined for every frame, to the speech likelihood measurement unit 16. The speech likelihood measurement unit 116 calculates speech likelihood for every frame in the speech production section, based on the sound source direction θ.

Like a case in which a microphone targets voice of a driver in a car compartment for sound collection, a direction of voice produced by a specific speaker is estimated in advance. Then, when the sound source direction θ is included in a range of the estimated speaker direction, the speech likelihood measurement unit 116 sets the speech likelihood relatively higher. In contrast, when the sound source direction θ is out of the range of the estimated speaker direction, the speech likelihood measurement unit 116 sets the speech likelihood relatively lower.

Figure 12:
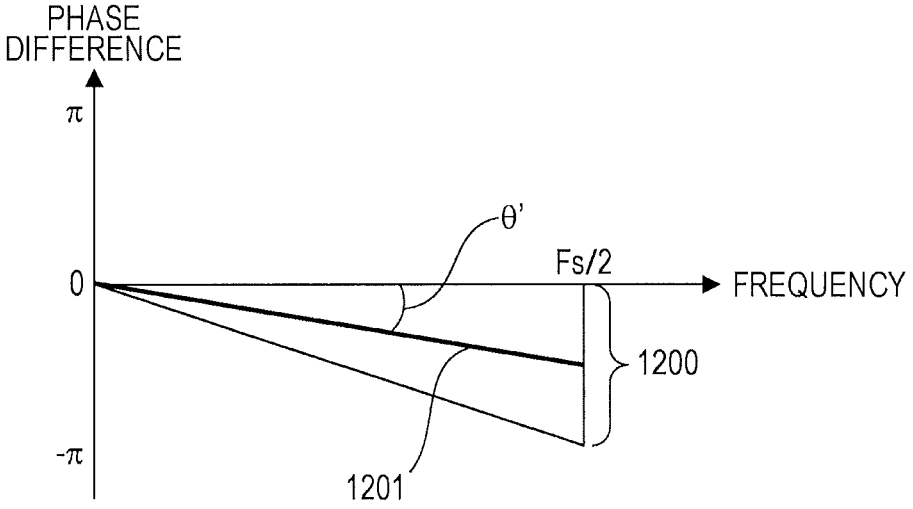
FIG. 12 is a view illustrating a relation of a sound source direction $\theta$ and an estimated speaker direction range.

FIG. 12 is a view illustrating a relation of a value θ' corresponding to a sound source direction θ (when θ=−π/2 and (Fs/s)>>π, then, θ'=−π(Fs/2). Therefore, θ'=θ/Fs) and a range of an estimated speaker direction. In FIG. 12, a horizontal axis represents a frequency and a vertical axis a phase difference in spectrums of a left input signal and a right input signal. For example, when a speaker to be estimated is on the left side to a normal line which passes through a midpoint of a line connecting the microphone 2-1 and the microphone 2-2, that is, on the side of the microphone 2-1, an estimated speaker's direction range 1200 is set on the negative side of the phase difference 0, with respect to the phase of the left input signal. Thus, as depicted by a line 1201, when the value θ' corresponding to the sound source direction θ is included in the range 1200, it is likely that the left input signal and the right input signal include the voice of the speaker to be estimated.

Figure 13:
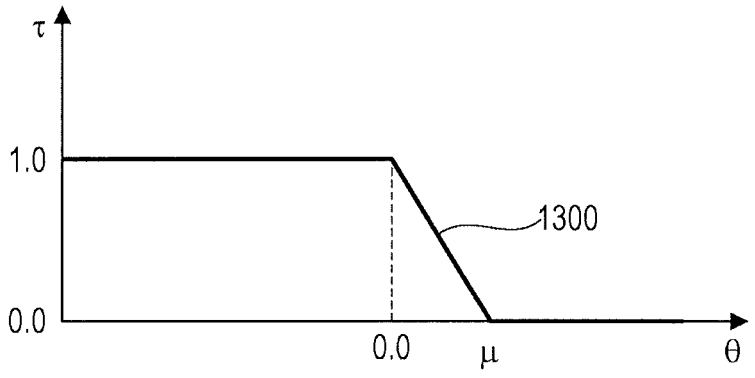
FIG. 13 is a view illustrating an example of a relation of the sound source direction $\theta$ and speech likelihood $\tau$.

FIG. 13 is a view illustrating an example of a relation of sound source direction θ and speech likelihood τ. In FIG. 13, a horizontal axis represents the sound source direction θ and a vertical axis the speech likelihood τ. Then a graph 1300 represents a relation of the sound source direction θ and the speech likelihood τ. In the example illustrated in FIG. 13, it is assumed that like FIG. 12, the range of the estimated speaker direction is a range in which the sound source direction θ has a negative value. Thus, since the sound source direction θ is included in the range of the estimated sound source direction when the sound source direction θ has a negative value, the speech likelihood measurement unit 16 sets the speech likelihood τ to 1.0.

On the other hand, when the sound source direction θ is equal to or more than 0 and equal to or less than an upper limit threshold μ, the speech likelihood measurement unit 116 linearly and monotonously reduces the speech likelihood τ as the sound source direction θ is larger. Note that the upper limit threshold μ is set to 0.1 radian, for example. Then, when the sound source direction θ exceeds the upper limit threshold μ, the speech likelihood measurement unit 116 sets the speech likelihood τ to 0.0.

The speech likelihood measurement unit 116 outputs the speech likelihood τ for every frame in the speech production section to the gain determination unit 114. The gain determination unit 114 outputs a corrected gain G' according to the expression (7), similar to the second embodiment. Then, the gain determination unit 114 outputs the corrected gain G' to the enhancement unit 152. Then, the enhancement unit 152 uses the corrected gain G' to enhance at last one of the left input signal and the right input signal.

Figure 14:
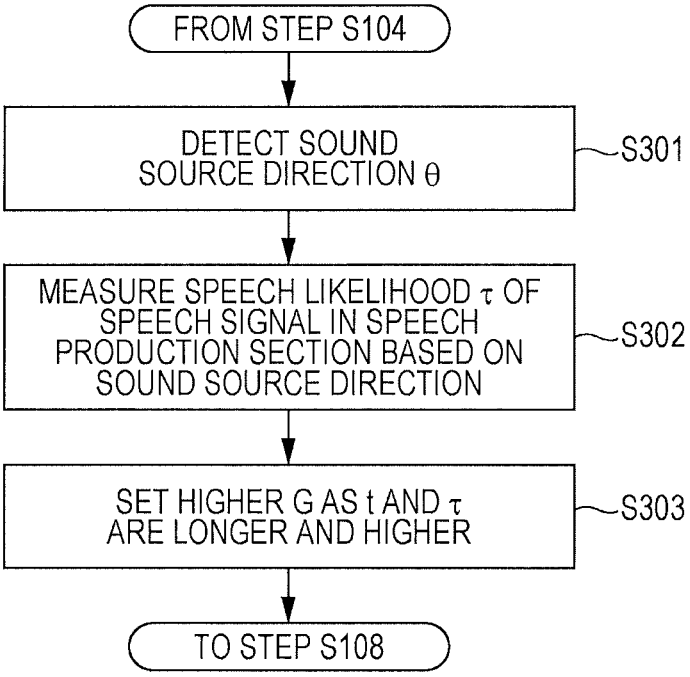
FIG. 14 is an operation flow chart of speech enhancement processing according to the third embodiment.

FIG. 14 is an operation flow chart of speech enhancement processing according to the third embodiment. The operation flow chart of the speech enhancement processing according to the third embodiment is different in the processing in step S107 from the operation flow chart of the speech enhancement processing according to the first embodiment. Then, in FIG. 14, processing to be performed instead of the processing in step S107 is described.

When it is judged in step S104 that an elapsed time t is between adjustment start time β, inclusive, and adjustment completion time β', exclusive, the sound source direction detection unit 17 detects the sound source direction θ from a difference between the arrival time of a left input signal and the arrival time of a right input signal (step S301). Then, the sound source direction detection unit 17 notifies the speech likelihood measurement unit 116 of the sound source direction θ. The speech likelihood measurement unit 116 determines speech likelihood τ of an input signal in a current frame based on the sound source direction θ (step S302). Then, the speech likelihood measurement unit 116 notifies the gain determination unit 114 of the speech likelihood τ.

The gain determination unit 114 sets a gain G so that the gain G is higher as the elapsed time t is longer and speech likelihood τ is higher (step S303). Then, the gain determination unit 114 outputs the gain G to the enhancement unit 152. Subsequently, the processor 52 performs the processing after step S108.

According to the third embodiment, since the speech enhancement device determines speech likelihood of an input signal in a speech production section based on a sound source direction determined from input signals collected by a plurality of microphones, the speech enhancement device may evaluate the speech likelihood appropriately. Therefore, the speech enhancement device may set an appropriate gain.

A speech enhancement device according to a fourth embodiment is described hereinafter. The speech enhancement device according to the fourth embodiment adjusts a gain according to a result of comparison of power of an input signal in a first half of a speech production section and power of an input signal in a second half. Note that the first half and the second half may not necessarily be exact 50% of the entire speech production section.

Figure 15:
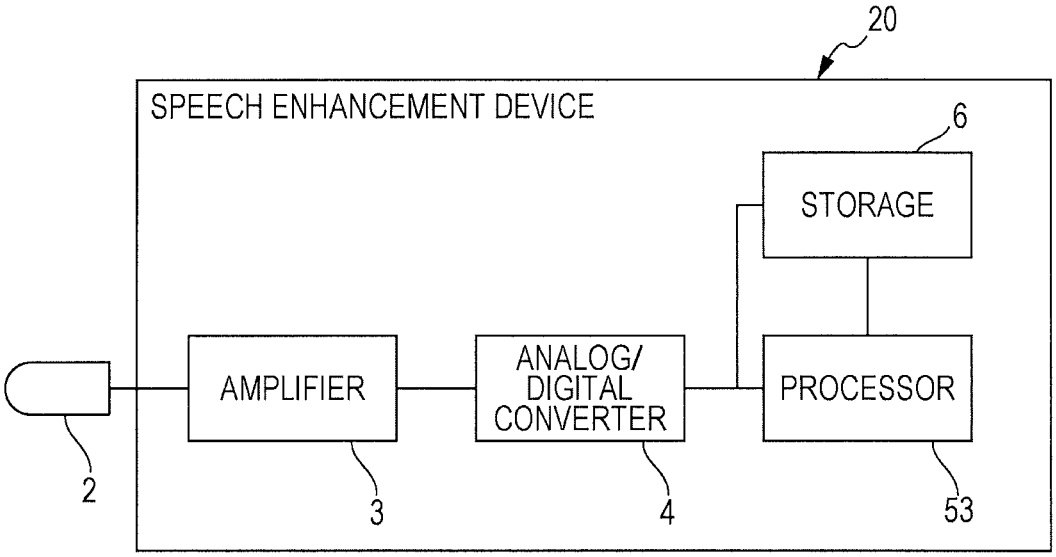
FIG. 15 is a schematic configuration diagram of a speech enhancement device according to a fourth embodiment.

FIG. 15 is a schematic configuration diagram of the speech enhancement device according to the fourth embodiment. A speech enhancement device 20 has a microphone 2, an amplifier 3, an analog/digital converter 4, a processor 53, and a storage 6.

The speech enhancement device 20 according to the fourth embodiment is different from the speech enhancement device 1 according to the first embodiment in that the speech enhancement device 20 has the storage 6 and that a part of processing to be performed by the processor 53 is different. Thus, the storage 6 and the processor 53 are described hereinafter.

The storage 6 has a readable and writable volatile memory circuit. Then, the storage 6 stores an input signal outputted from the analog/digital converter 4 till speech enhancement processing ends. For every speech production section, the storage 6 also stores a power integration value of each frame in the speech production section.

The processor 53 has a power calculation unit 11, a speech production section detection unit 12, a timer unit 13, a gain determination unit 14, and an enhancement unit 15, similar to the processor 5 of the speech enhancement device 1 according to the first embodiment.

The speech production section detection unit 12 judges for every frame whether or not the frame is included in a speech production section, and stores a power integration value P of the frame that is judged to be included in the speech production section.

In addition, when the speech production section detection unit 12 judges that the speech production section ends, more specifically, when a last frame is included in the speech production section and a current section is not included in the speech production section, the speech production section detection unit 12 notifies the gain determination unit 14 that the speech production section ends.

The gain determination unit 14 reads a power integration value of each frame in a speech production section from the storage 6. Then, the gain determination unit 14 calculates an average value $P_{fav}$ of power integration values of respective frames included in the first half of the speech production section and an average value $P_{sav}$ of power integration values of respective frames included in the second half of the speech production section.

The gain determination unit 14 determines an upper limit α of the gain G following the expression below, according to a result of comparison of the average value $P_{fav}$ of power integration values of frames included in the first half of the speech production section and the average value $P_{sav}$ of power integration values of frames included in the second half of the speech production section.

$$\alpha=(P_{fav}/P_{sav})^{0.5}\text{: when } P_{fav}>P_{sav}\text{, and } P_{sav}\approx 0.0$$

$$\alpha=1.0\text{: In other cases} \quad (9)$$

As illustrated in the expression (9), when the average value $P_{sav}$ of power integration values of frames included in the second half of the speech production section falls below the average value $P_{fav}$ of power integration values of frames included in the first half of the speech production section, the gain determination unit 14 sets the upper limit α of the gain G larger than 1.0. On the other hand, when the average value $P_{sav}$ of power integration values of frames included in the second half of the speech production section does not drop with respect to the average value $P_{fav}$ of power integration values of frames included in the first half of the speech production section, the gain determination unit 14 sets the upper limit α of the gain G to 1.0. Therefore, in the fourth embodiment, when volume of speech produced by the speaker drops in the second half of the speech production section, the input signal is enhanced, whereas the input signal is not enhanced when the volume of speech produced by the speaker does not drop in the second half of the speech production section. Hence, in the fourth embodiment, excessive enhancement of an input signal is controlled and consequently distortion of the input signal is suppressed.

Figure 16:
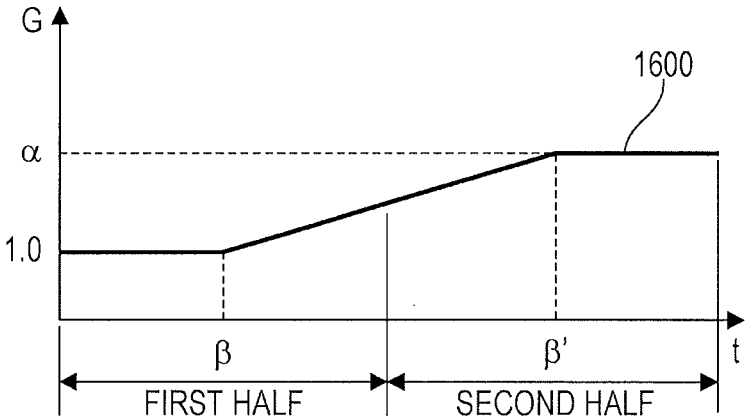
FIG. 16 is a view illustrating other example of a relation of an elapsed time from a starting point of a speech production section and a gain.

FIG. 16 is a view illustrating other example of a relation of an elapsed time from a starting point of a speech production section and a gain. In FIG. 16, a horizontal axis represents an elapsed time and a vertical axis a gain. Then, a graph 1600 represents a relation of the elapsed time and the gain. As illustrated in the graph 1600, a gain G is kept at 1.0 till the elapsed time from a starting point of a speech production section exceeds the adjustment start time β which is set in a first half of the speech production section. Then, after the elapsed time exceeds the adjustment start time β, the gain G linearly and monotonously increases as the elapsed time is longer, and is set to an invariable value a at a time point when the elapsed time reaches the adjustment completion time β' which is set in the second half of the speech production section. Then, after the elapsed time exceeds the adjustment completion time β', the gain G is kept at the level of α, so that the level of an input signal becomes discontinuous and distortion of the input signal does not become too large. Then, when the speech production section ends, the gain G is reset to 1.0.

Note that the adjustment start time β may be set at any point in the first half of the speech production section, for example, a midpoint in the first half of the speech production section. In addition, the adjustment completion time β' may be set at any point in the second half of the speech production section, for example, a midpoint in the second half of the speech production section. Alternatively, the adjustment start time β and the adjustment completion time β' may be set similar to those in the embodiments described above.

Following the graph illustrated in FIG. 16, the gain determination unit 14 sets a gain G for each frame in the speech production section according to the elapsed time from the starting point of the speech production section. Note that the gain determination unit 14 sets a gain G for a frame not included in the speech production section to 1.0. Then, the gain determination unit 14 outputs the gain G for each frame in the speech production section to the enhancement unit 15. The enhancement unit 15 reads an input signal from the storage 6 and enhances the input signal using the gain G determined for every frame.

Figure 17:
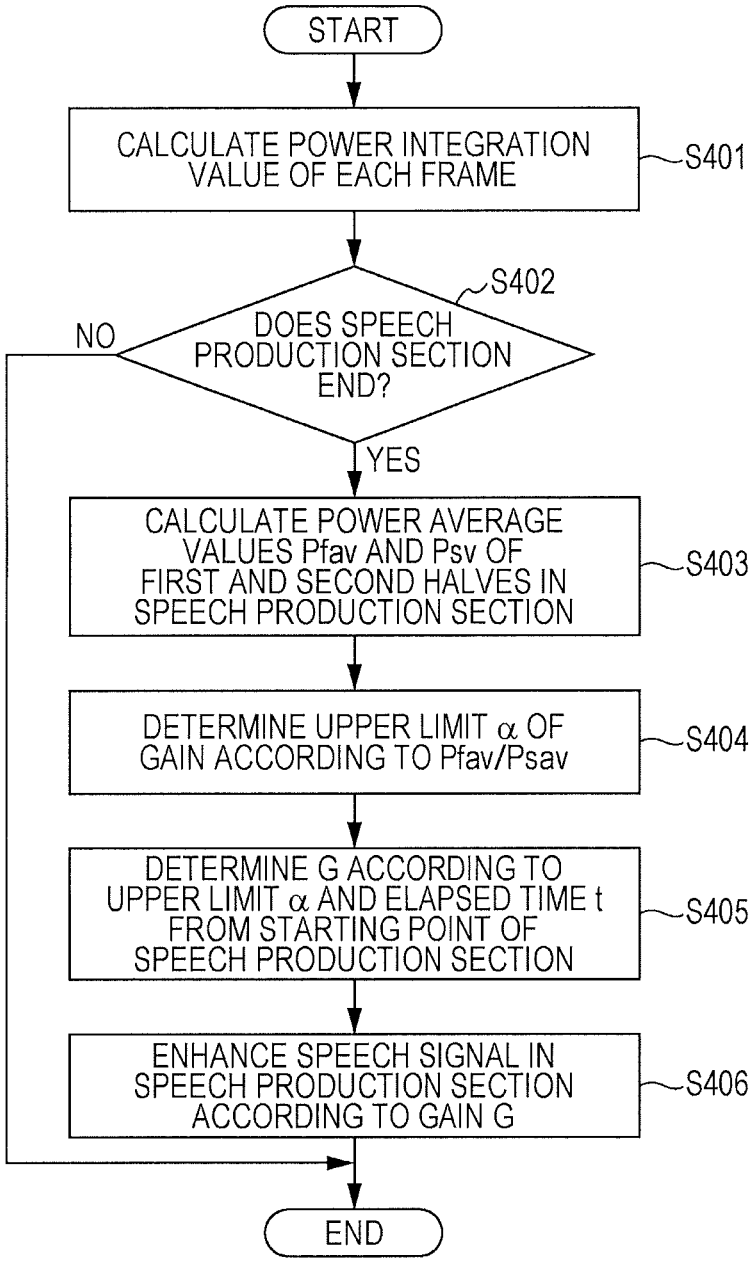
FIG. 17 is an operation flow chart of speech enhancement processing according to the fourth embodiment.

FIG. 17 is an operation flow chart of speech enhancement processing according to the fourth embodiment. The speech enhancement device 20 performs speech enhancement processing for every frame according to the following operation flow chart.

The power calculation unit 11 divides an input signal for every frame and calculates a power integration value of a current frame (step S401). Then, the power calculation unit 11 outputs the power integration value to the speech production section detection unit 12 and a spectrum signal of each frequency to the speech production section detection unit 12 and the enhancement unit 15.

Based on the power integration value, the speech production section detection unit 12 judges whether or not a speech production section ends (step S402). When the speech production section does not end (step S402—No), the speech production section detection unit 12 stores the power integration value in the storage 6. Then, the processor 53 finishes the speech enhancement processing. On the other hand, when the speech production section ends (step S402—Yes), the speech production section detection unit 12 notifies the gain determination unit 14 of the judgment result.

The gain determination unit 14 reads a power integration value of each frame in the speech production section from the storage 6 and calculate a power average value $P_{fav}$ and a power average value $P_{sav}$ of first and second halves in the speech production section (step S403). Then, the gain determination unit 14 determines an upper limit α of the gain G according to $P_{fav}/P_{sav}$.

The gain determination unit 14 determines the gain G according to the upper limit α and the elapsed time t from a starting point of the speech production section (step S405). Then, the gain determination unit 14 notifies the enhancement unit 15 of the gain G.

The enhancement unit 15 reads an input signal from the storage 6 and enhances an input signal in the speech production section according to the gain G to obtain a corrected input signal (step S406). Subsequently, the speech enhancement device 20 finishes the speech enhancement processing.

According to the fourth embodiment, since the speech enhancement device may adjust a gain according to a result of comparison of power in a first half and a power in a second half of a speech production section, the speech enhancement device may set the gain according to a degree of power drop in the second half of the speech production section. In addition, according to the fourth embodiment, since the speech enhancement device may adjust timing of when a gain begins to increase, according to length of a speech production section, the speech enhancement device may appropriately set gain adjustment timing according to an individual difference such as speech speed and the like.

Then, a speech enhancement device according to a fifth embodiment is described hereinafter. The speech enhancement device according to the fifth embodiment adaptively determines the adjustment start time β of a gain G by detecting attenuation of power in an input signal according to an elapsed time in a speech production section.

Figure 18:
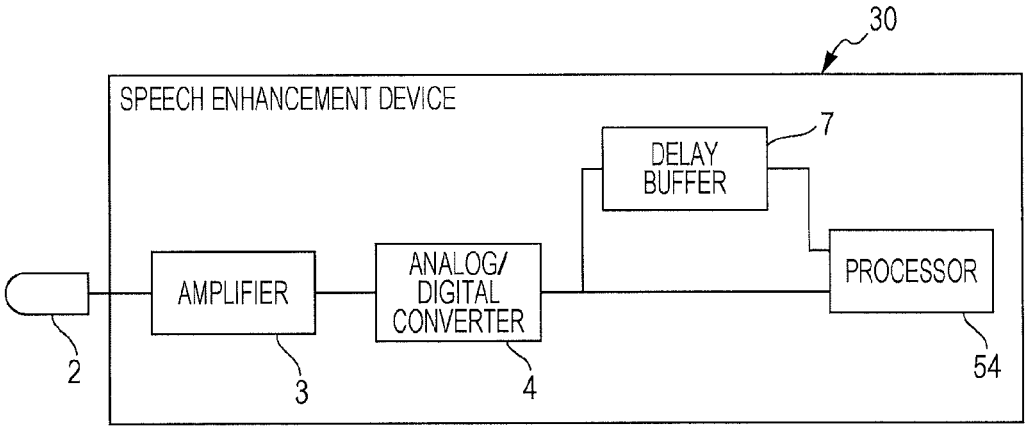
FIG. 18 is a schematic configuration diagram of a speech enhancement device according to a fifth embodiment.

FIG. 18 is a schematic configuration diagram of the speech enhancement device according to the fifth embodiment. A speech enhancement device 30 has a microphone 2, an amplifier 3, an analog/digital converter 4, a processor 54, and a delay buffer 7.

The speech enhancement device 30 according to the fifth embodiment is different from the speech enhancement device 1 according to the first embodiment in that the speech enhancement device 30 has the delay buffer 7. Furthermore, the speech enhancement device 30 according to the fifth embodiment is different, in a part of processing of the processor 54, from the speech enhancement device 1 according to the first embodiment. Thus, the following description is provided for the delay buffer 7, the processor 54, and parts related thereto.

The delay buffer 7 has a delay circuit configured to output an inputted input signal after delaying the inputted input signal by a predetermined delay time. In the fifth embodiment, the delay time is set to a time which it takes for the processor 54 to detect attenuation of an input signal, 200 msec, for example. Then, the delayed input signal outputted from the delay buffer 7 is inputted to the processor 54.

Figure 19:
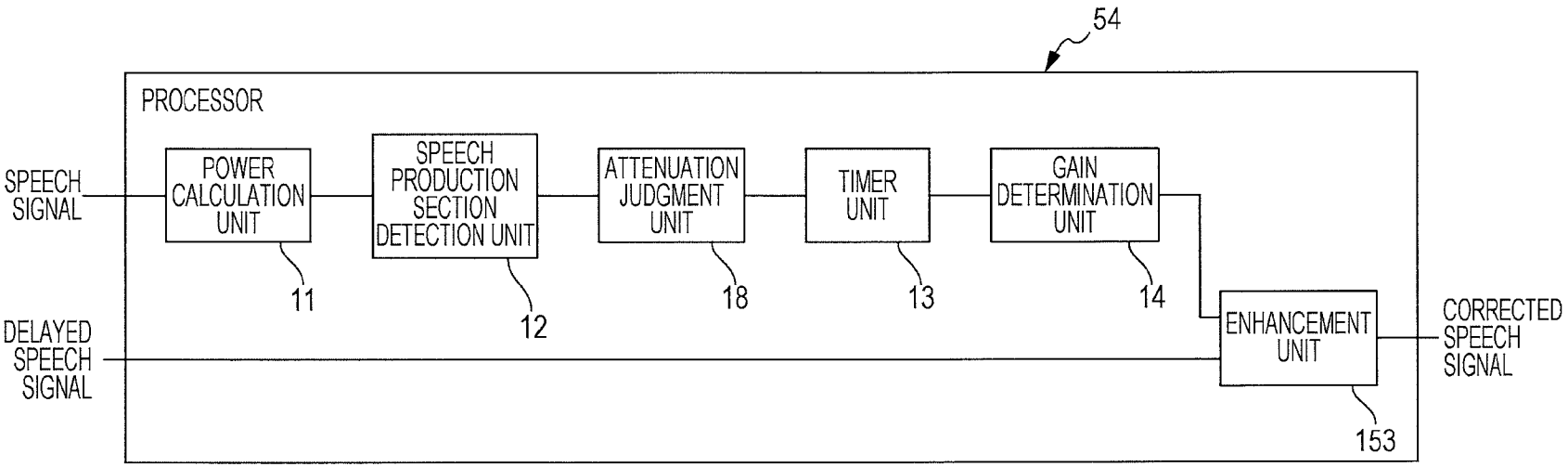
FIG. 19 is a schematic configuration diagram of a processor of the speech enhancement device according to the fifth embodiment.

FIG. 19 is a schematic configuration diagram of the processor of the speech enhancement device according to the fifth embodiment. The processor 54 has a power calculation unit 11, a speech production section detection unit 12, a timer unit 13, a gain determination section 14, an enhancement unit 153, and an attenuation judgment unit 18. The processor 54 is different from the processor of the speech enhancement device according to the fourth embodiment in that the processor 54 has the attenuation judgment unit 18 and that processing of the enhancement unit 153 is different. Thus, the attenuation judgment unit 18 and the enhancement unit 153 are described hereinafter.

The attenuation judgment unit 18 judges for each frame in a speech production section whether or not attenuation occurs on an input signal at a leading part of the speech production section. Thus, the attenuation judgment unit 18 detects a maximum value $P_{max}$ of power integration values of respective frames from a starting point in a speech production section till a threshold determination period, as a reference value to determine an attenuation judgment threshold Th to detect power attenuation. Note that the threshold determination period is set to a period during which volume of speech produced by a speaker does not attenuate, 100 msec, for example, which corresponds to one to two vowels.

The attenuation judgment unit 18 sets as the attenuation judgment threshold Th a value obtained by subtracting a predetermined offset value (1.0 dB, for example) from the maximum value $P_{max}$ of the power integration values. Then, the attenuation judgment unit 18 compares the power integration value P with the attenuation judgment threshold Th for each frame from the starting point of the speech production section till after the threshold determination period elapses. Then, when the power integration value P is continuously less than the attenuation judgment threshold Th for a predetermined period T, the attenuation judgment unit 18 judges that the input signal has attenuated. Note that the predetermined period T is set to the delay time by the delay buffer 7 or a time obtained by multiplying the delay time by a safety coefficient less than 1 (0.9 to 0.95, for example), 200 msec, for example.

The attenuation judgment unit 18 notifies the gain determination unit 14 of a time point earlier by the predetermined period T than the time point when it was judged that the input signal attenuated, as an attenuation start time.

Figure 20:
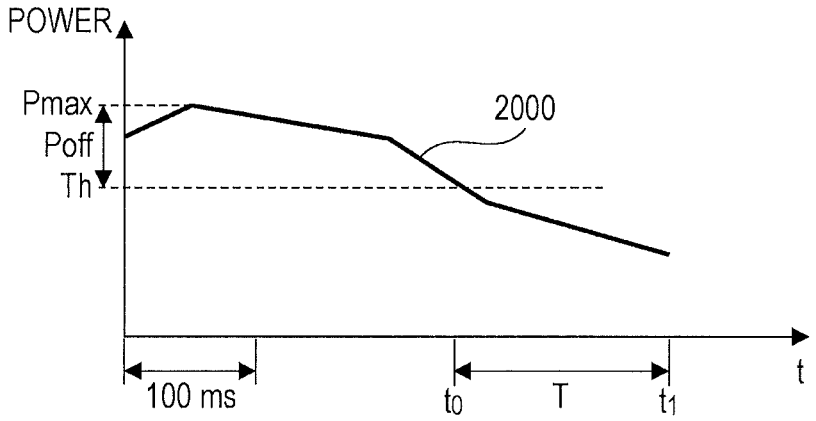
FIG. 20 is a view illustrating a relation of temporal change of power of an input signal in a speech production section and an attenuation judgment threshold.

FIG. 20 is a view illustrating a relation of temporal change of power of an input signal in a speech production section and an attenuation judgment threshold Th. In FIG. 20, a horizontal axis represents an elapsed time and a vertical axis power. A graph 2000 represents temporal change of power of an input signal in a speech production section. As illustrated in FIG. 20, the attenuation judgment threshold Th is set to a value obtained by subtracting an offset value Poff from the maximum value Pmax of the power integration value from the starting point of the speech production section till the threshold determination period (100 msec). Then, in this example, at time point $t_1$, the power integration value is continuously less than the attenuation judgment threshold Th over the predetermined period T. Thus, time point $t_0$ which is earlier by the period T than the time point $t_1$ is the attenuation start time. That is to say, when a period during which power of an input signal is less than the threshold Th is shorter than the predetermined value T, the input signal is judged as not being attenuated.

The gain determination unit 14 determines the gain G setting the attenuation start time as the adjustment start time β. Then, the gain determination unit 14 outputs the gain G to the enhancement unit 153.

The enhancement unit 153 uses the gain G from the attenuation start time to perform speech enhancement processing on the input signal inputted from the delay buffer 7.

Figure 21:
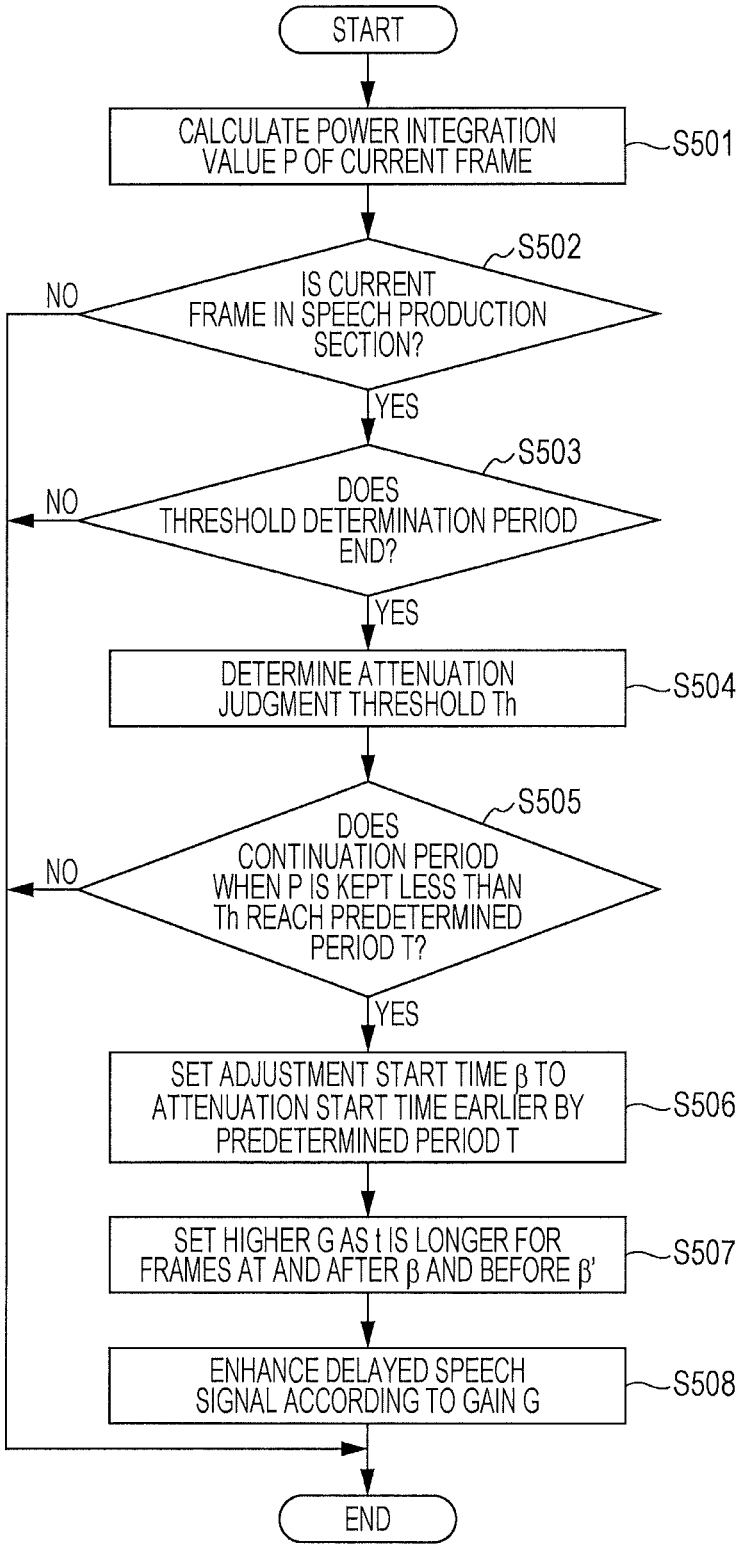
FIG. 21 is an operation flow chart of speech enhancement processing according to the fifth embodiment.

FIG. 21 is an operation flow chart of speech enhancement processing according to the fifth embodiment. The speech enhancement device 30 performs speech enhancement processing for every frame according to the following operation flow chart.

The power calculation unit 11 divides an input signal for every frame and calculates a power integration value of a current frame (step S501). Then, the power calculation unit 11 outputs the power integration value to the speech production section detection unit 12 and the attenuation judgment unit 18 and a spectrum signal of each frequency to the speech production section detection unit 12 and the enhancement unit 153.

Based on the power integration value, the speech production section detection unit 12 judges whether or not the current frame is in the speech production section (step S502). If the current frame is out of the speech production section (step S502—No), the processor 54 finishes the speech enhancement processing. On the other hand, when the current frame is included in the speech production section (step S502—Yes), the speech production section detection unit 12 notifies the attenuation judgment unit 18 and the gain determination unit 14 of the judgment result.

The attenuation judgment unit 18 judges whether or not the threshold determination period from the beginning of the speech production section ends in the current frame (step S503—No). When the threshold determination period does not end (step S503—No), the processor 54 finishes the speech enhancement processing. On the other hand, when the threshold determination period ends (step S503—Yes), the attenuation judgment unit 18 determines the attenuation judgment threshold Th based on the maximum value Pmax of the power integration values in the threshold determination period (step S504).

The attenuation judgment unit 18 also judges whether or not a continuation period during which the power integration period P is kept less than the attenuation judgment threshold Th reaches the predetermined period T (step S505). When the continuation period does not reach the predetermined period T (step S505—No), the processor 54 finishes the speech enhancement processing. On the other hand, when the continuation period reaches the predetermined period T (step S505—Yes), the attenuation judgment unit 18 sets a time point earlier by the predetermined period T than the current frame as the attenuation start time. Then, the attenuation judgment unit 18 notifies the gain determination unit 14 of the attenuation start time.

The gain determination unit 14 sets the attenuation start time as the adjustment start time β (step S506). Then, the gain determination unit 14 sets the gain G higher as the elapsed time t from the starting point of the speech production section is longer, for each of frames after the adjustment start time β and before the adjustment completion time β' (step S507). Then, the gain determination unit 14 notifies the enhancement unit 153 of the gain G.

The enhancement unit 153 enhances the delayed input signal, inputted from the delay buffer 7, according to the gain G to obtain a corrected input signal (step S508). Subsequently, the speech enhancement device 30 finishes the speech enhancement processing.

According to the fifth embodiment, the speech enhancement device may start speech enhancement processing of an input signal when the input signal begins to attenuate in a speech production section. Thus, the speech enhancement device may appropriately enhance the input signal in the speech production section.

Note that more than one of the embodiments described above may be combined. For example, the second or third embodiment may be combined with the fourth or fifth embodiment. Alternatively, the fourth embodiment and the fifth embodiment may be combined.

In addition, when the speech enhancement device has a plurality of microphones, the speech production section detection unit 12 may judge for every frame whether or not the sound source direction θ is included in an estimated speaker's direction range. Then, when the sound source direction θ is included in the estimated speaker's direction range, the speech production section detection unit 12 may judge that the frame is included in the speech production section.

Furthermore, the speech enhancement device according to each of the embodiments described above or a variation may be incorporated in a mobile phone, for example, correct an input signal generated by other device. In this case, the input signal corrected by the speech enhancement device is reproduced from a speaker that the device incorporating the speech enhancement device has.

Furthermore, a computer program configured to cause a computer to implement a function that a processor of the speech enhancement device according to the embodiments described above or the variation has may be provided in a form recorded in a computer-readable medium such as a magnetic recording medium or an optical recording medium. Note that the recording medium does not include a carrier.

Figure 22:
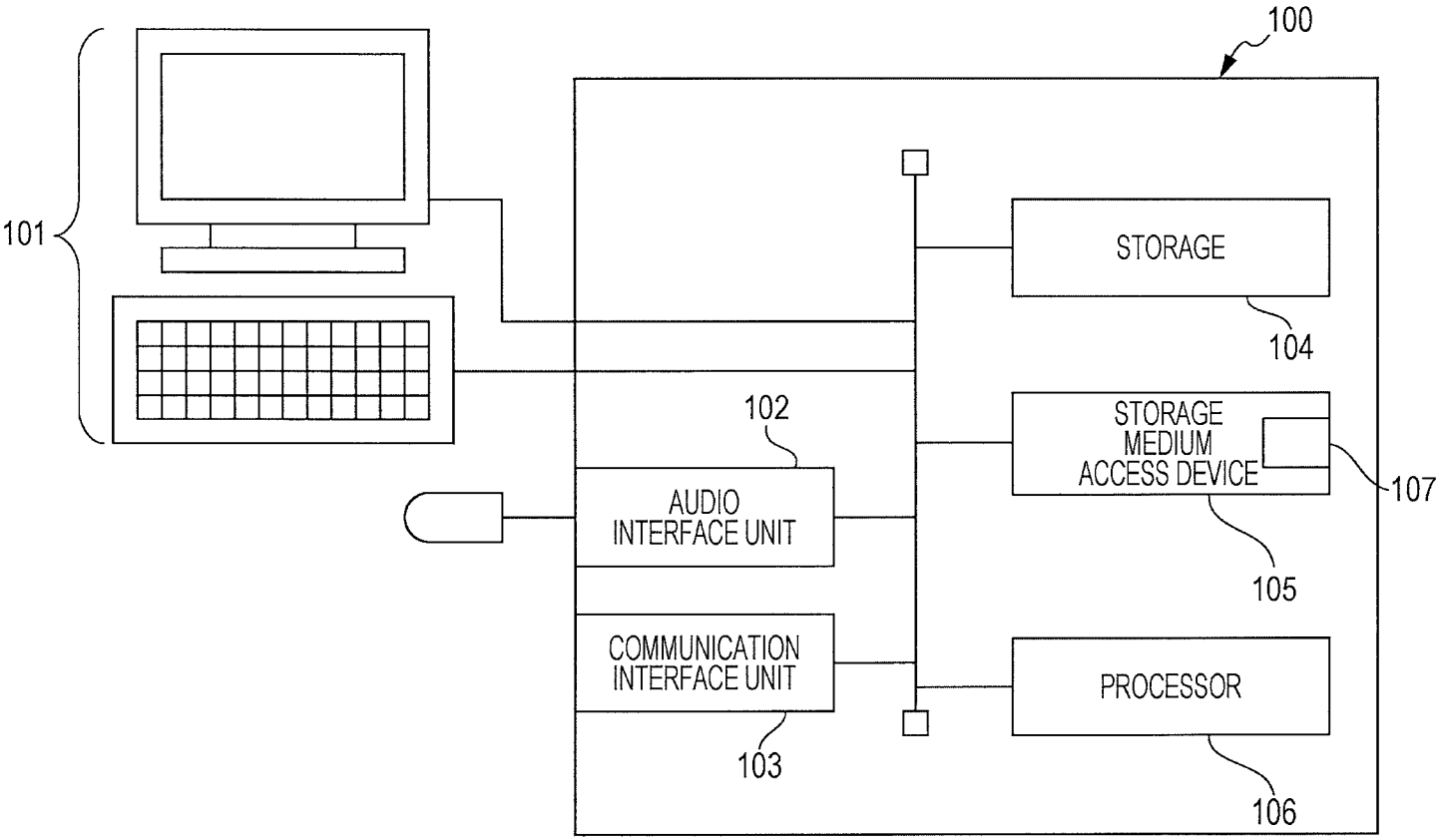
FIG. 22 is a configuration diagram of a computer which acts as a speech enhancement device through operation of a computer program configured to implement a function of the processor of the speech enhancement device according to any of the embodiments described above or a variation of the embodiments.

FIG. 22 is a configuration diagram of a computer which acts as a speech enhancement device through operation of a computer program configured to implement a function of the processor of the speech enhancement device according to any of the embodiments described above or the variation.

A computer 100 has a user interface unit 101, an audio interface unit 102, a communication interface unit 103, a storage 104, a storage medium access device 105, and a processor 106. The processor 106 is connected with the user interface unit 101, the audio interface unit 102, the communication interface unit 103, the storage 104, and the storage medium access device 105 via a bus, for example.

The user interface unit 101 has an input device such as a keyboard and a mouse, for example, and a display unit such as a liquid crystal display. Alternatively, the user interface unit 101 may have a device such as a touch panel display, in which an input device and a display device are integrated. Then, according to user manipulation, for example, the user interface unit 101 outputs, to the processor 106, an operation signal to start speech enhancement processing on an input signal inputted via the audio interface unit 102.

The audio interface unit 102 has an interface circuit configured to connect the computer 100 to a speech input device which generates an input signal of a microphone and the like. Then, the audio interface unit 102 acquires an input signal from the speech input device and passes the input signal to the processor 106.

The communication interface unit 103 has a communication interface configured to connect the computer 100 to a communication network that complies with a communication standard such as Ethernet (registered trademark) and a control circuit of the communication interface. Then, the communication interface unit 103 outputs a data stream including a corrected input signal, which is received from the processor 106, to other device via the communication network. The communication interface unit 103 may also acquire a data stream including an input signal from other device connected to the communication network and pass the data stream to the processor 106.

The storage 104 has a readable and writable semiconductor memory and a read-only semiconductor memory, for example. Then, the storage 104 stores a computer program to execute speech enhancement processing which is performed on the processor 106 and data generated in the course of the processing or as a result of the processing.

The storage medium access device 105 is a device that accesses a storage medium 107 such as a magnetic disk, a semiconductor memory card, and an optical recording medium, for example. The storage medium access device 105 reads a computer program for speech enhancement processing, which is stored in the storage medium 107 and performed on the processor 106, and passes the computer program to the processor 106.

The processor 106 corrects the input signal received via the audio interface unit 102 or the communication interface unit 103 by executing the computer program for speech enhancement processing according to any of each of the embodiments described above or of the variation. Then, the processor 106 stores the corrected input signal in the storage 104 or outputs the corrected input signal to other devices via the communication interface unit 103.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A speech enhancement device, comprising:

a memory, and a processor coupled to the memory and configured to;

detect a speech production section, in which a speaker produces speech, from an input signal generated by the speaker;

measure an elapsed time from a starting point of the speech production section;

set a gain that represents a level of enhancement of the input signal to a first value until the elapsed time reaches a predetermined time;

set the gain to a value higher than the first value when the elapsed time exceeds the predetermined time;

measure a speech likelihood which represents a likelihood of human voice of the input signal in the speech production section;

set the gain higher as the speech likelihood is higher;

detect a sound source direction which represents a direction of a sound source of the input signal based on the input signal;

set the speech likelihood higher when the sound source direction is included in a preset direction range, and set the speech likelihood lower when the sound source direction is out of the preset direction range; and output a signal based on the input signal in the speech production section according to the gain using the processor even when a volume of speech produced by the speaker changes during the speech production section.

2. The speech enhancement device according to claim 1, wherein the processor is further configured to:

store the input signal in a storage, detect an end of the speech production section, read the input signal in the speech production section out from the storage when the end of the speech production section is detected, calculate an average value of power of the input signal in a first half of the speech production section, calculate an average value of power of the input signal in a second half of the speech production section, and determine the gain according to a ratio of the average value of the power of the input signal in the first half to the average value of the power of the input signal in the second half.

3. The speech enhancement device according to claim 1, wherein the processor is further configured to:

judge an attenuation time point when the input signal begins to attenuate in the speech production section, and set the attenuation time point as the predetermined time.

4. The speech enhancement device according to claim 1, wherein the processor is further configured to increase the gain as the elapsed time is longer after the elapsed time exceeds the predetermined time.

5. A speech enhancement method, comprising:

detecting a speech production section, in which a speaker produces speech, from an input signal generated by the speaker;

measuring an elapsed time from a starting point of the speech production section;

setting a gain that represents a level of enhancement of the input signal to a first value until the elapsed time reaches a predetermined time;

setting the gain to a value higher than the first value when the elapsed time exceeds the predetermined time;

measuring a speech likelihood which represents a likelihood of human voice of the input signal in the speech production section;

set the gain higher as the speech likelihood is higher;

detecting a sound source direction which represents a direction of a sound source of the input signal based on the input signal;

setting the speech likelihood higher when the sound source direction is included in a preset direction range, and setting the speech likelihood lower when the sound source direction is out of the preset direction range; and outputting a signal based on the input signal in the speech production section according to the gain using a processor even when a volume of speech produced by the speaker changes during the speech production section.

6. A non-transitory and computer-readable recording medium having stored a program for causing a computer to execute a speech enhancement process comprising:

detecting a speech production section, in which a speaker produces speech, from an input signal generated by the speaker;

measuring an elapsed time from a starting point of the speech production section;

setting a gain that represents a level of enhancement of the input signal to a first value until the elapsed time reaches a predetermined time;

setting the gain to a value higher than the first value when the elapsed time exceeds the predetermined time;

measuring a speech likelihood which represents a likelihood of human voice of the input signal in the speech production section;

set the gain higher as the speech likelihood is higher;

detecting a sound source direction which represents a direction of a sound source of the input signal based on the input signal;

setting the speech likelihood higher when the sound source direction is included in a preset direction range, and setting the speech likelihood lower when the sound source direction is out of the preset direction range; and outputting a signal based on the input signal in the speech production section according to the gain using the computer even when a volume of speech produced by the speaker changes during the speech production section.

* * * * *